United States Patent [19]

Getchell

[11] 3,992,749

[45] Nov. 23, 1976

[54] DRAPERY SLIDE AND ADJUSTABLE CLIP COMBINATION

[76] Inventor: F. Grant Getchell, 570 Antelope Way, Eugene, Oreg. 97401

[22] Filed: July 21, 1975

[21] Appl. No.: 597,476

[52] U.S. Cl. ..... 16/93 D; 24/73 R; 24/255 D; 24/255 H

[51] Int. Cl.[2] ..... A47H 15/00

[58] Field of Search ..... 24/73 R, 73 CH, 73 GS, 24/73 AS, 255 D, 255 H, 255 FC, 255 GP, 255 G, 255 R, 137 R, 67.9; 16/87.2, 93 D–96 D

[56] References Cited

UNITED STATES PATENTS 3,688,341 9/1972 Pechham ..... 16/93 D 3,883,924 5/1975 Grabman ..... 16/95 D

*Primary Examiner*—Werner H. Schroeder
*Assistant Examiner*—Doris L. Troutman
*Attorney, Agent, or Firm*—James D. Givnan, Jr.

[57] ABSTRACT

A carrier and clip combination slidably mounted in a traverse rod to support a drapery. The carrier and clip include cooperating projections and apertures permitting selective engagement of one to the other so as to correctly locate the drapery hem with respect to the floor. The clip is of bifurcated shape with an irregular surface for purposes of drapery retention.

6 Claims, 7 Drawing Figures

DRAPERY SLIDE AND ADJUSTABLE CLIP COMBINATION

BACKGROUND OF THE INVENTION

The present invention relates generally to drapery traverse rods and more particularly to a novel slide and adjustable clip combination.

Widely used in the installation of draperies are traverse rods with slidable carriers, the number of carriers determined by the drapery width. Each carrier is apertured to receive a drapery inserted hook. The carriers are slidable within the rod in response to opening and closing movement of the drapery with a master carrier imparting movement to the drapery.

Installation of draperies at a desired height requires that each of the drapery inserted hooks be at a certain, uniform distance from the upper edge of the drapery. A mistake in the vertical spacing of the hooks from the upper edge of the drapery will necessitate the entire operation being re-accomplished entailing the removal of the drapery from its supporting rod, removal and re-installation of the hooks and finally, tedious insertion of the hooks into their respective carriers. A similar problem results in achieving proper drapery hanging after the draperies are cleaned and pressed during which shrinkage often takes place. In any event, to relocate the drapery bottom edge relative to a floor surface, the drapery hooks must all be removed and re-installed which is a time-consuming, tedious operation. A further objection to known drapery carrier and hook combinations results from the minimal engagement of the drapery hook with the drapery pleat. Instead of always being supported in an upright manner the drapery pleat will often be inclined from the vertical by reason of drapery weight.

SUMMARY OF THE PRESENT INVENTION

The present invention is embodied within a combination drapery carrier and adjustable clip facilitating adjustable attachment of a drapery to a supporting traverse rod.

The present slide is adapted for movement along a traverse rod in response to opening and closing movement of a drapery. A clip is adjustably mounted on each slide member by means of a series of vertically spaced apertures for selective engagement with projections thereby determining the relationship of a drapery bottom with a floor surface. Said relationship may be varied simply by dis-engagement and reengagement of the clip and slide member which is done successively along the drape thereby obviating complete drape separation from the traverse rod. The curtain clip is provided with an irregular drapery-engaging surface to assure proper drapery retention.

Important objects of the invention include a drapery carrier and clip combination permitting convenient attachment of a drapery to a traverse rod in a manner permitting vertical adjustment of the drapery simply by repositioning of the clip on the carrier; the provision of the present combination wherein the drapery clip is provided with a regular surface for purposes of positive drapery retention; the provision of a drapery clip having a downwardly inserted arm for engagement with a drapery pleat; the provision of a drapery carrier and clip combination having an adjustable mounting arrangement permitting the drapery clip to be raised or lowered relative to a traverse rod simply by manual effort alone without tools and without incurring the arduous task of completely removing a drapery and re-installing same on the carriers; the provision of a drapery slide having multiple projections for a selective engagement with certain openings vertically spaced along a drapery clip; the provision of a drapery clip in permanent engagement with a drapery even during cleaning and pressing operations.

DETAILED DECRIPTION OF THE PREFERRED EMBODIMENTS

Figure 1:
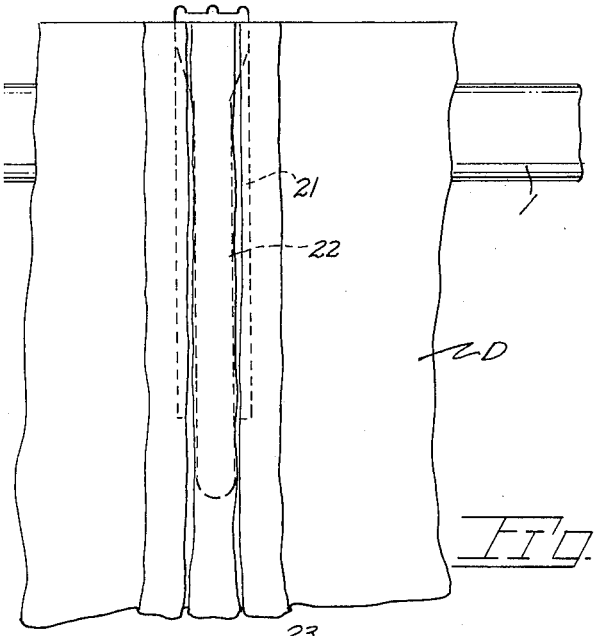
FIG. 1 is front elevational view of a drapery segment and traverse rod section with the present carrier and clip supporting the drapery.
Figure 2:
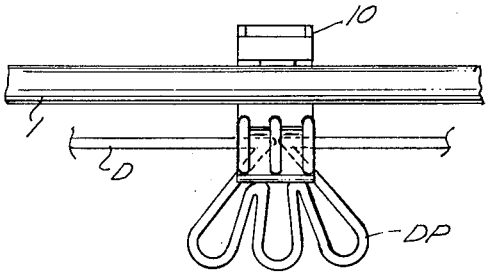
FIG. 2 is a plan view of FIG. 1.

With continuing reference to the drawing wherein applied reference numerals indicate parts similarly identified in the following description, the reference numeral 1 indicates a traverse rod of conventional C-shaped configuration normally provided with a series of carriers slidably mounted therein and supporting the drapery for opening and closing movement along the traverse rod. A drapery is indicated at D, is pleated at DP in the usual manner.

Figure 6:
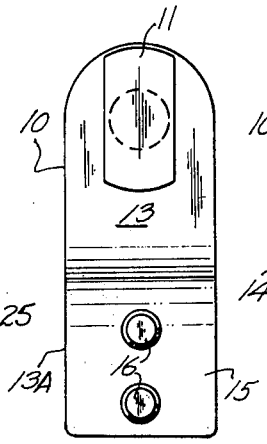
FIG. 6 is a front elevational view of the drapery carrier removed from the traverse rod.
Figure 7:
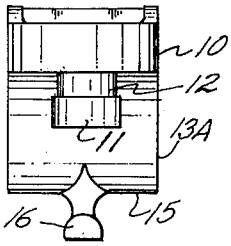
FIG. 7 is a top plan view of FIG. 6.
Figure 4:
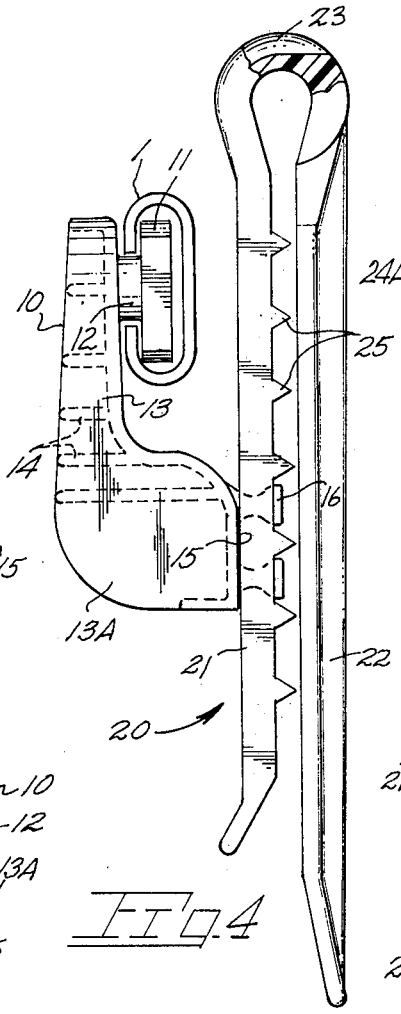
FIG. 4 is a side elevational view of the present drapery carrier and clip combination mounted within a traverse rod with the drapery removed.

With particular attention to FIGS. 4, 6 and 7, a drapery carrier is indicated at 10, said carrier including a head 11 for disposition within the traverse rod 1. A neck portion 12 is of a size to move freely within the traverse rod slotted opening not unlike previously known carriers. Integral with head 11 and neck 12 is a main carrier body 13, preferably of molded construction, and of irregular configuration by reason of an enlarged lower portion 13A. Internal ribs at 14 contribute rigidity to the carrier body portion. A forward wall 15 is provided on the carrier from which wall extends projections 16 the latter constituting a part of cooperating means enabling selective attachement of the later described clip with the carrier. Projections 16 terminate outwardly in enlarged, spherical, truncated ends as best shown in FIG. 7.

Figure 3:
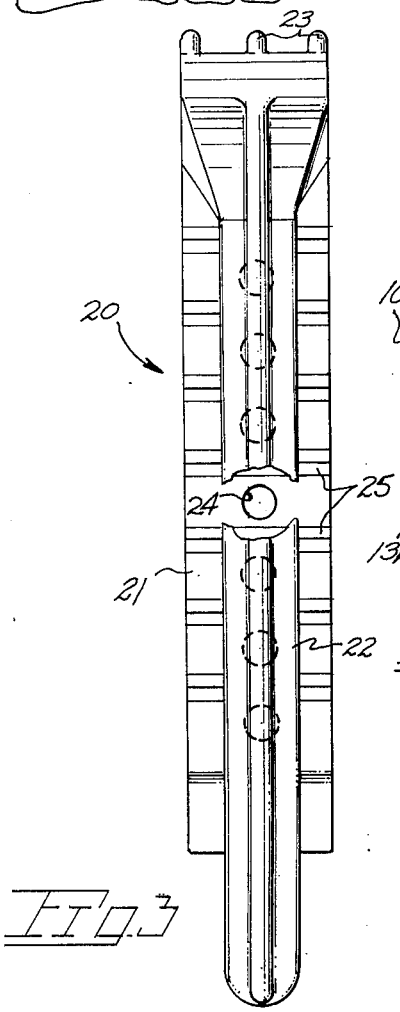
FIG. 3 is a front elevational view of the clip with fragments broken away.
Figure 5:
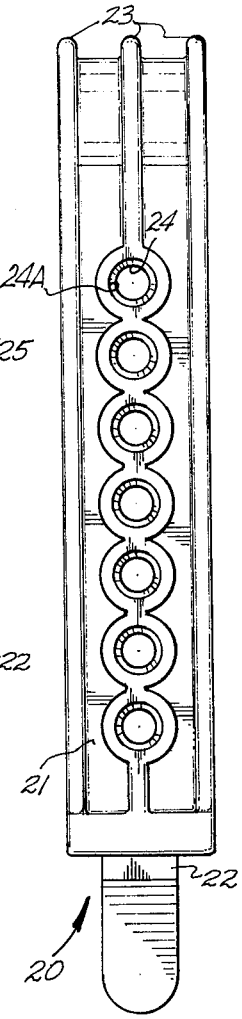
FIG. 5 is a rear elevational view of the drapery clip.

In FIGS. 3, 4, and 5 a drapery clip is indicated generally at 20 and is of bifurcated configuration having a primary arm 21 and a secondary or outer arm 22. Preferably clip 20 is of molded construction and of a durable, resinous plastic to provide a clip of a semi-rigid nature adapted for gripping engagement with that portion of a drapery immediately rearwardly of a drapery pleat. With attention to FIG. 5, primary arm 21 has re-inforcing ribs 23 extending therealong. Additionally cooperating means shown as apertures 24 are formed along said arm. Each of the spaced apart apertures are desirably provided with a beveled outer periphery 24A to facilitate engagement with remaining cooperating means in the form of projections 16 on the carrier. The diameter of apertures 24 is slightly undersized relative to the diameter of spherical projection 16 to accomplish a snug, pressed fit therewith. As viewed in FIG. 4 said projections extend through the apertures to the extent that the primary arm is securely held in place against wall 15 of the carrier. The resinous nature of the material used permits passage of the slightly larger projections 16 through the undersized apertures 24. Accordingly the clip is supported against both vertical loads as well as laterally applied loads imparted during opening and closing movement of the draperies. Secondary arm 22 of the clip is of reduced section to enable engagement with the drapery within an area defined by the pleated portion of the drapery. Initial engagement of the clip with the drapery requires simply a slight spreading of the clip arms for downward passage of arm 22 into the pleat opening. An irregular surface along primary arm 21 is provided by ridges 25 which when the clip is on the drapery imbed themselves into the drapery material to resist downward slippage of the drapery.

In a drapery installing operation the clips 20 are applied to the draperies rearward of the pleat. With the clips in place on the drapery the drapery is applied to the traverse rod simply by clip engagement with projections 16 within any of the various cooperating apertures 24. The hanging or hem height of the drapery may be initially determined with the first clip carrier engagement and thereafter the remaining clips and carriers being combined with the same set of apertures of each clip. Adjustments are accomplished simply by clip disengagement and remounting on the carrier.

While I have shown but one embodiment of the invention it will be apparent to those skilled in the art that the invention may be embodied still otherwise without departing from the spirit and scope of the invention.

Having thus described the invention, what is desired to be secured under a Letters patent is:

I claim:

1. A carrier and drapery clip combination for suspending draperies from traverse rod, said combination comprising, a carrier including a laterally offset head slidably mounted in the traverse rod, said carrier having an enlarged lower portion terminating forwardly in a forward wall surface forwardly offset from the traverse rod, a bifurcated clip member having primary and secondary arms in biased engagement with the upper marginal area of a drapery, said clip member adapted for downward attachment to the drapery upper edge, and cooperating means carried by said carrier and said clip member permitting selective engagement of said clip and carrier members to vary the height of a drapery hem above a floor surface.

2. The combination claimed in claim 1 wherein said cooperating means includes horizontally directed projections on said carrier, said primary arm of the bifurcated clip member defining a series of vertically spaced apertures for selected engagement with said projections to facilitate locating the drapery hem at a desired height above the floor.

3. The combination claimed in claim 2 wherein said carrier wall surface and said clip member are in abutting relationship.

4. The combination claimed in claim 2 wherein said projections are of hemispherical shape.

5. The combination claimed in claim 4 wherein each of said apertures is of non-constant diameter.

6. The combination claimed in claim 5 wherein said clip has vertically spaced ridges on said primary arm for drapery retention purposes, said secondary arm being of lesser size in section than said primary arm to facilitate insertion within a drapery pleat.

* * * * *